United States Patent [19]

Moore

[11] Patent Number: 4,860,949

[45] Date of Patent: Aug. 29, 1989

[54] MAILBOX SIGNALING ARRANGEMENT

[76] Inventor: John R. Moore, 2303 Orchard Rd., Evansville, Ind. 47712

[21] Appl. No.: 180,783

[22] Filed: Apr. 12, 1988

[51] Int. Cl.[4] ..... B65D 91/00

[52] U.S. Cl. ..... 232/35

[58] Field of Search ..... 232/17, 34, 35

[56] References Cited

U.S. PATENT DOCUMENTS

| | | | |
|---|---|---|---|
| 2,730,298 | 1/1956 | Haserodt | 232/35 |
| 3,343,784 | 9/1967 | Waldhaus et al. | 232/35 |
| 4,473,182 | 9/1984 | Dion | 232/35 |
| 4,491,268 | 1/1985 | Faulkingham | 232/35 |
| 4,648,012 | 3/1987 | Pittman | 232/17 X |

*Primary Examiner*—Robert W. Gibson, Jr.

*Attorney, Agent, or Firm*—Warren D. Flackbert

[57] ABSTRACT

A mailbox signaling arrangement cooperably responsive to pivotal movement of the entry lid of a common rural mailbox characterized by a pivotal signal plate member and, optionally, the selective energization of a light source. Operation of the signaling arrangement is occasioned by the release of the aforesaid signal plate member (which is continually urged to a signaling position) as a result of entry lid movement, with the signal plate member also initiating operation of the light source when at such signaling position.

4 Claims, 1 Drawing Sheet

MAILBOX SIGNALING ARRANGEMENT

As is known, a rural type mailbox is typically located at a site distant from, for example, a residence, as along a fronting road. A need exists, however, especially for the aged and/or the incapacitated, for knowledge of a mail delivery without the necessity of a time consuming walk to the mailbox location. The latter also could be complicated by weather conditions, such as snow or ice.

The present invention presents a mailbox signaling arrangement which is multi-functional, i.e. presents a mechanical signal whenever the mailbox lid is opened and, further, may or may not include the simultaneous illumination of an electric bulb, if so arranged. In other words, a user can visually determine, by long range inspection, if there has been a mail delivery.

More specifically, the instant mailbox signaling arrangement is defined by a series of interconnected linkages which raise a signal flag from a lower to an upper position upon lid movement and, at the same time, movement of the lid can complete the circuit to an electric bulb for further signaling purposes, assuming the arrangement is so assembled.

In any event, a better understanding of the present invention will become more apparent from the following description, taken in conjunction with the accompanying drawing, wherein FIG. 1 is a view in side elevation, partly fragmentary, showing a mailbox signaling arrangement in accordance with the teachings of the present invention;

Figure 1:
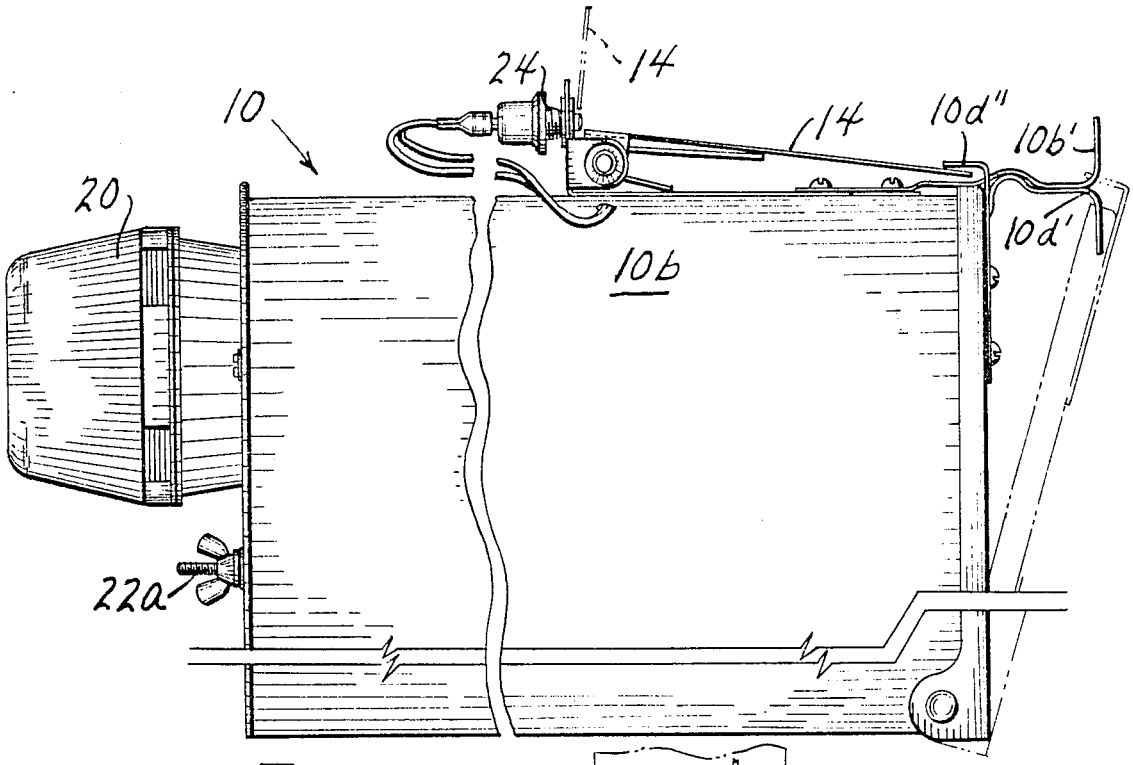

For the purposes of promoting an understanding the principles of the invention, reference will now be made to the embodiment illustrated in the drawing and specific language will be used to describe the same. It will nevertheless be understood that no limitations of the scope of the invention is thereby intended, such alterations and further applications of the principles of the invention as illustrated therein being contemplated as would normally occur to one skilled in the art to which the invention relates.

Referring now to the figures, a conventional rural mailbox 10 is disclosed, such having a base 10*a*, a top wall 10*b* blending into side walls, a rear wall 10*c*, and a conventional pivotal entry lid 10*d*. The lid 10*d* includes a latching member 10*b'* cooperable with a latching member 10*d'* disposed on the top wall 10*b* of the mailbox 10. In other words, the lid 10*d* is movable from a latched or closed position (shown in solid lines in FIG. 1) to an unlatched or opened position (shown in phantom lines in FIG. 1).

A control unit 12 is secured to the top wall 10*b* of the mailbox 10, typically including a base plate 12*a* having an upstanding end 12*b* with curved forwardly extending (in the direction of the lid 10*d*) ears or projections 12*c*. The projections 12*c* serve to position a pivotal signal plate member 14 mounted on an axle 15 extending therebetween, where a spring 17, also mounted on the axle 15, continually urges the signal plate member 14 in an upward direction, i.e. away from the top of the mailbox 10.

In other words, when the entry lid 10*d* is open, for access into the mailbox 10, a stop member 10*d''* mounted on the front of the lid 10*d*, and normally overlying the free end of the pivotal signal plate member 14 moves, releasing the latter to the phantom line position of FIG. 1 (due to the force provided by spring 17). At this time, and since the signal plate member 14 is extending in an upwardly direction, the user can readily determine mailbox 10 opening and mail delivery.

Figure 3:
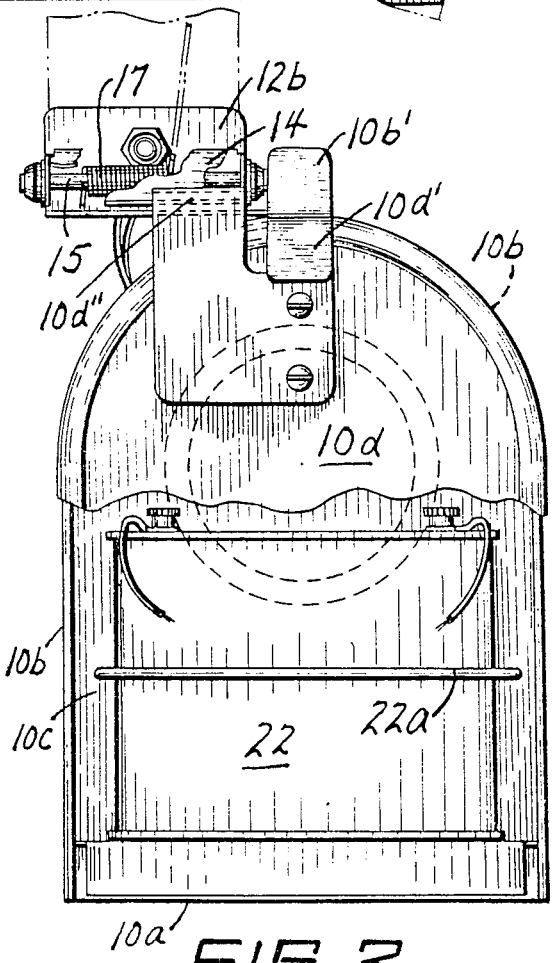
FIG. 3 is a view in front elevation, looking from right to left in FIG. 1, still further detailing the invention.

Further signaling can be achieved through the provision of a light source 20, such as an electric bulb within an enclosure, mounted on the rear wall 10*c* of the mailbox 10. The electrical circuitry to the light source 20 includes a battery 22 (see FIG. 3), positioned by a wing nut-U-bolt arrangement 22*a*, and a pressure responsive switch 24 secured to the upstanding end 12*b* of the base plate 12*a*.

Figure 2:
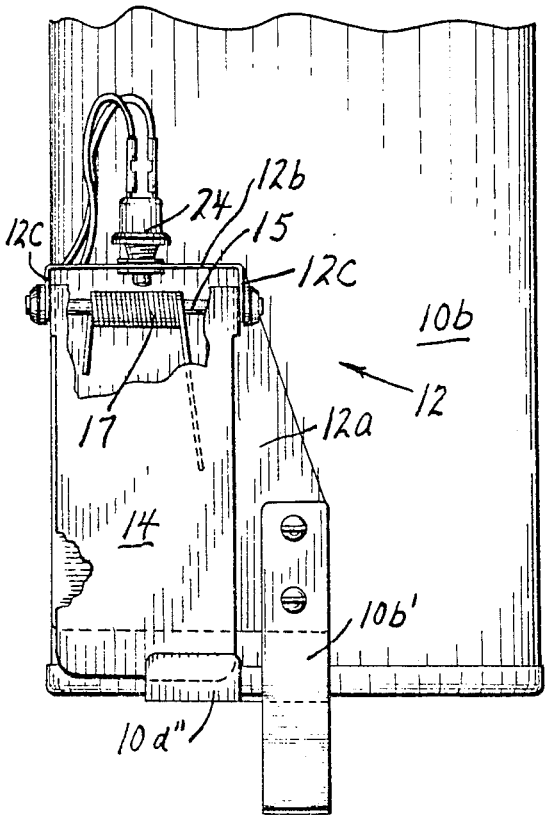
FIG. 2 is a top plan view, further detailing the invention.

As apparent in FIGS. 1 and 2, when the signal plate member 14 is at a raised position (the phantom line showing of FIG. 1), contact is made with switch 24, causing completion of the electrical circuit and the illumination of the light source 20. In other words, the usage of the light source 20 indicator implements the above-described pivotal signal plate member 14. However, and depending on needs, the use of such is optional.

It should be evident from the preceding that the mailbox signaling arrangement described herein effectively serves a significant need, i.e. a ready determination of mail delivery while viewing the mailbox at a location remote from such. As mentioned, the invention is twofold in usage, presenting a pivotal signal plate member which raises vertically when the mailbox entry lid is opened and where a light source may also become energized with entry lid movement. The preceding is accomplished through a simple arrangement of components which cooperate positively to assure end results.

The mailbox signaling arrangement described hereabove is, of course, susceptible to various changes within the spirit of the invention, including, by way of example, proportioning; the type of light source employed; the manner of providing power to the light source; and, the like. Thus, the preceding description should be considered illustrative and not as limiting the scope of the following claims:

I claim:

1. A signaling arrangement for a delivery box including a top wall, side walls, a back wall, and a bottom wall arranged to present an article receiving cavity, comprising a control unit mounted on said top wall and including a one-piece pivotal laterally extending signal plate member retained in a non-signaling position by a latch and selectively movable from said non-signaling position to an upwardly directed signaling position upon release of said latch by outward movement of the latter in response to delivery of an article, and spring means continually urging said signal plate member from said non-signaling position to said signaling position, where electrical switching means is disposed on said top wall of said delivery box for selective energization by movement of said signal plate member to said signaling position, where said electrical switching means is part of an electrical circuit including a power source and a light source, and where said signal plate member remains at said signaling position until said article is removed and the signal plate member returned to a non-signaling position upon inward movement of said latch to a retaining relationship therewith.

2. A signaling arrangement for a mailbox including an arcuate top wall blending into side walls, a back wall, a bottom wall and a pivotal entry lid, comprising a control unit mounted on said top wall and including a pivotal signal plate member movable from a non-signaling position to an upwardly directed signaling position, spring means continually urging said signal plate member from said non-signaling position to said signaling position, and means on said pivotal entry lid overlying a portion of said signal plate member and maintaining such at a non-signaling position until said pivotal lid is moved to a mailbox access condition, where electrical switching means is disposed on said top wall of said mailbox for selective energization by movement of said signal plate member, and where said electrical switching means is part of an electrical circuit including a power source and a light source.

3. The signaling arrangement of claim 2 where said means on said pivotal entry lid is a projection.

4. The signaling arrangement of claim 2 where said electrical switching means includes a switch selectively engaged by said signal plate member.

* * * * *